United States Patent [19]

Ribout et al.

[11] 4,178,533

[45] Dec. 11, 1979

[54] MICROWAVE DELAY LINE FOR TRAVELLING WAVE TUBE

[75] Inventors: Pierre Ribout; Bernard Delory, both of Paris, France

[73] Assignee: Thomson-CSF, Paris, France

[21] Appl. No.: 833,646

[22] Filed: Sep. 15, 1977

[30] Foreign Application Priority Data

Sep. 21, 1976 [FR] France ..... 7628319

[51] Int. Cl.[2] ..... H01J 25/34

[52] U.S. Cl. ..... 315/3.6; 29/600; 315/3.5; 333/162

[58] Field of Search ..... 315/3.5, 3.6, 39.3; 29/600; 333/31 R

[56] References Cited

U.S. PATENT DOCUMENTS

| | | | |
|---|---|---|---|
| 2,955,223 | 10/1960 | Kompfner et al. | 315/3.5 |
| 3,089,975 | 5/1963 | Washburn, Jr. | 315/3.5 X |
| 3,121,819 | 2/1964 | Wilmarth | 315/3.6 |
| 3,421,040 | 1/1969 | Winslow | 315/3.5 |
| 3,435,273 | 3/1969 | Kennedy | 315/3.5 X |
| 3,716,745 | 2/1973 | Phillips | 315/3.5 |
| 3,735,188 | 5/1973 | Anderson et al. | 315/3.5 |
| 3,808,677 | 5/1974 | Eallonardo | 29/600 |
| 4,004,197 | 1/1977 | Phillips | 315/3.5 |

*Primary Examiner*—Saxfield Chatmon, Jr.
*Attorney, Agent, or Firm*—Roland Plottel

[57] ABSTRACT

An helical type line for travelling wave tube, with a variable diamter. The line is made on a skew surface constituted by a revolution surface on which flat surfaces have been made. The variation of the line diameter may be carried out by a variation of the revolution surface diameter, the flat surfaces being parallel to the axis of the revolution surface. That variation may be also carried out by a variation of the angle made by the flat surfaces in relation to the helix axis, the revolution surface being cylindrical.

9 Claims, 17 Drawing Figures

MICROWAVE DELAY LINE FOR TRAVELLING WAVE TUBE

The present invention covers a microwave delay line of roughly helicoidal structure, intended more especially for travelling wave tubes.

As is known, a travelling wave tube is formed by the association of a long thin electron beam with a non-resonant, periodic structure delay line. Electrons give energy to the microwave passing through the line when the conditions for synchronism of the wave with the beam are respected.

For the periodic line, a helical structure is very often used. A helical line is normally made as follows: it is wound round a cylindrical mandrel which is later eliminated. Then it is placed in the cylindrical tube in which the electrons move, and is held there by insulating supports in the shape of bars between the helix and the tube.

However, the improvement of certain characteristics of travelling wave tubes, such as the gain or the efficiency, results in the use in certain cases of a structure which is wound round a surface that is no longer cylindrical but conical, in order to produce a variable diameter line. Such an arrangement has a technological disadvantage: it is difficult to make two conical surfaces with perfectly identical slopes, the surfaces concerned being the one supporting the helix on the one hand and that of the insulating bars or internal tube surface on the other.

According to the invention, there is provided a microwave delay line for a travelling wave tube, of roughly helical shape, having a longitudinal axis and which has a skew surface comprising a revolution surface and flat surfaces, said skew surface having zones extending over the whole lengh on said line, said zones being parallel to said axis.

For a better understanding of the invention, and to show how it may be carried into effect, reference will be made to the following description and the attached drawings, which show:

in FIG. 1, a diagramatic view of a travelling wave tube containing a conical-shaped, helical delay line, in FIG. 2, a perspective view of a first embodiment of the delay line in accordance with the invention;

in FIG. 3, a longitudinal section of the preceding Figure, in FIGS. 4 and 5, transverse sections of the line shown in FIG. 2;

in FIG. 6, a perspective view of a second embodiment of the delay line in accordance with the invention;

in FIG. 7, a longitudinal section of the preceding Figure;

in FIGS. 8*a* and 8*b*, transverse sections of the line shown in FIG. 6;

in FIG. 9, a perspective view of a third embodiment of the delay line in accordance with the invention;

in FIG. 10, a perspective view of a mandrel which is used to produce the line shown in FIG. 9;

in FIG. 11, a longitudinal section of the line shown in FIG. 9;

in FIG. 12, a transverse section of the line shown in FIG. 9;

in FIG. 13, a perspective view of a fourth embodiment of the delay line in accordance with the invention;

in FIG. 14, a perspective view of a mandrel which, is used to produce the line shown in FIG. 13;

in FIG. 15, a longitudinal section of the line shown in FIG. 13;

in FIG. 16, a transverse section of the line shown in FIG. 13.

In these various figures, on the one hand, the same references are related to the same elements and, on the other hand, the device has been shown to an arbitarily chosen scale.

In the diagram of FIG. 1 can be seen:

an electron gun formed by a cathode K, which emits an electron beam 3, a control electrode W of the grid type and an anode A;

a helical delay line 4, for example of roughly conical shape, surrounding electron beam 3;

a focussing device 5 for electron beam 3 during its trajectory along the line 4;

a collector C of the beam electrons 3;

an input 1 and an output 2 for the microwave energy passing through line 4.

A short recapitulation of the operation of such a device may be given: the velocity of the electrons in beam 3 is modulated periodically by the field connected with the wave moving along line 4. Under the influence of this velocity modulation, the electrons are grouped in batches and there is an energy transfer from the electron batches to the wave travelling in the line, provided that there is a condition of equality satisfied between the electron velocity and one of the phase velocities of the wave passing through the line.

Figure 1:
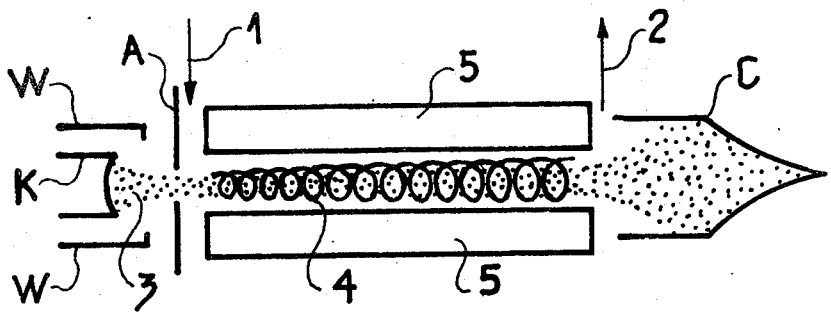

On these figures is shown a tube 48, which is metallic and cylindrical, its axis being ZZ, and which contains line 4 in the middle of which passes the electron beam along axis ZZ.

During manufacture, line 4 is held by a mandrel in the shape of a truncated cone 49, whose axis is ZZ and which is shown on FIG. 3; this mandrel is removed later. The small base of the truncated cone 49 is of diameter 2D and the large base of diameter 2R. Mandrel 49 and also line 4 have as many flat surfaces as there are supports for line 4, i.e. three in the example given, items 41, 42 and 43. The flat surfaces are parallel to axis ZZ and at a distance equal to the radius D from it, so that the distance from a flat surface to the inside surface of tube 48 is constant.

Line 4 is formed by a conductor of rectangular section for example, wound on mandrel 49.

Line 4 is held in tube 48 by insulating rods (44, 45 and 46) which, thanks to the flat surfaces 41, 42 and 43, may be of rectangular longitudinal section.

Figure 3:
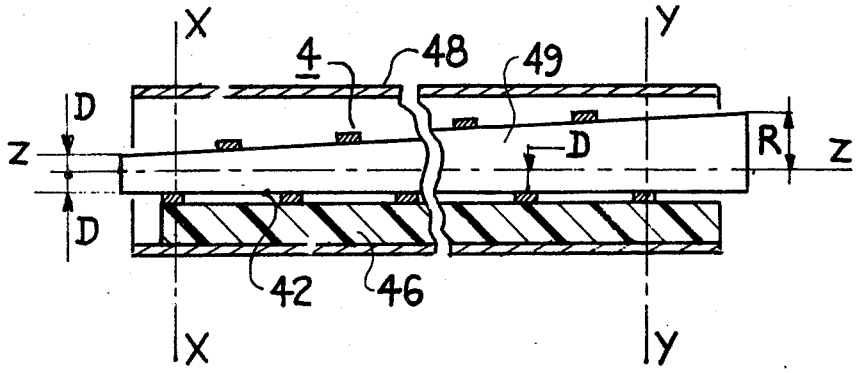
FIG. 3 shows the same line seen in longitudinal section along the axis ZZ.

For clearness, the section in FIG. 3 has been made alons axis ZZ to the right of a flat surface (42).

Figure 2:
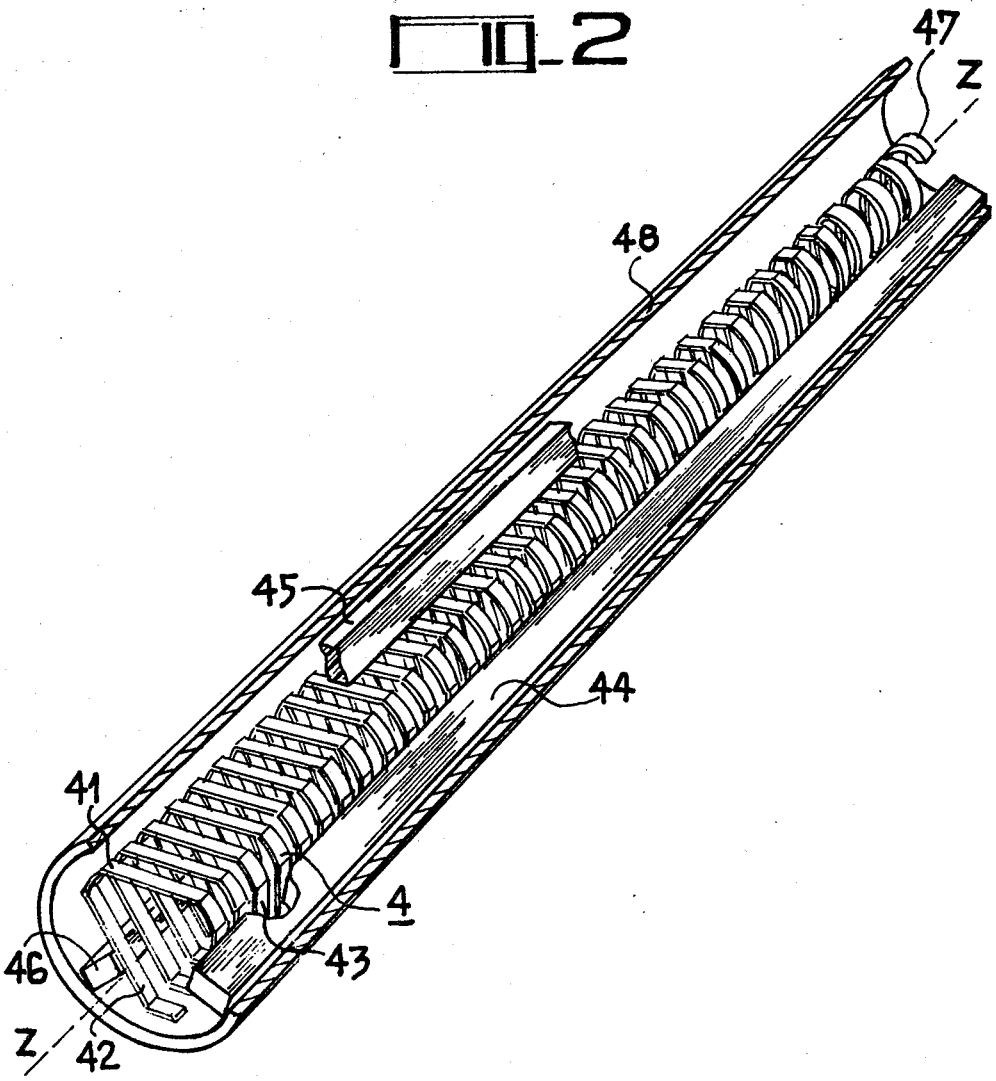
FIG. 2 shows a perspective view of a first embodiment of line 4 of the preceding Figure, in accordance with the invention.
Figure 4:
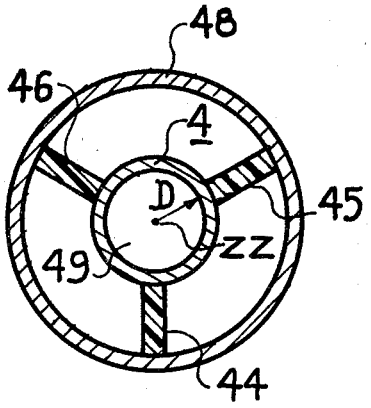

FIG. 4 is a view of a transverse section of the line shown in FIGS. 2 and 3, made along axis XX of FIG. 3, i.e. along the smaller of its bases.

Line 4 is then circular, of radius D and insulated from tube 48 by rods 44, 45 and 46.

Figure 5:
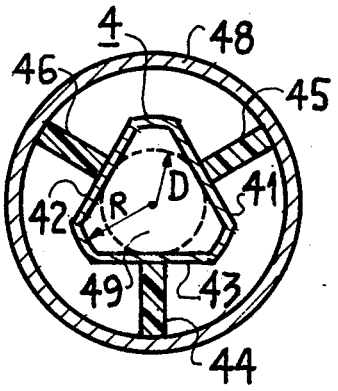

FIG. 5 is a view of a transverse section of the line shown in FIG. 3, along axis YY i.e. along the larger of its bases.

Line 4 is then of radius R for its curved parts and has three flat parts corresponding to flat surfaces 41, 42 and 43 of mandrel 49. It is insulated from tube 48 by rods 45, 46 and 44 which are of the same section as in FIG. 4 and are placed respectively at the level of the preceding flat surfaces. The circle inscribed in the figure formed by line 4 in FIG. 5 is of radius D.

Figure 6:
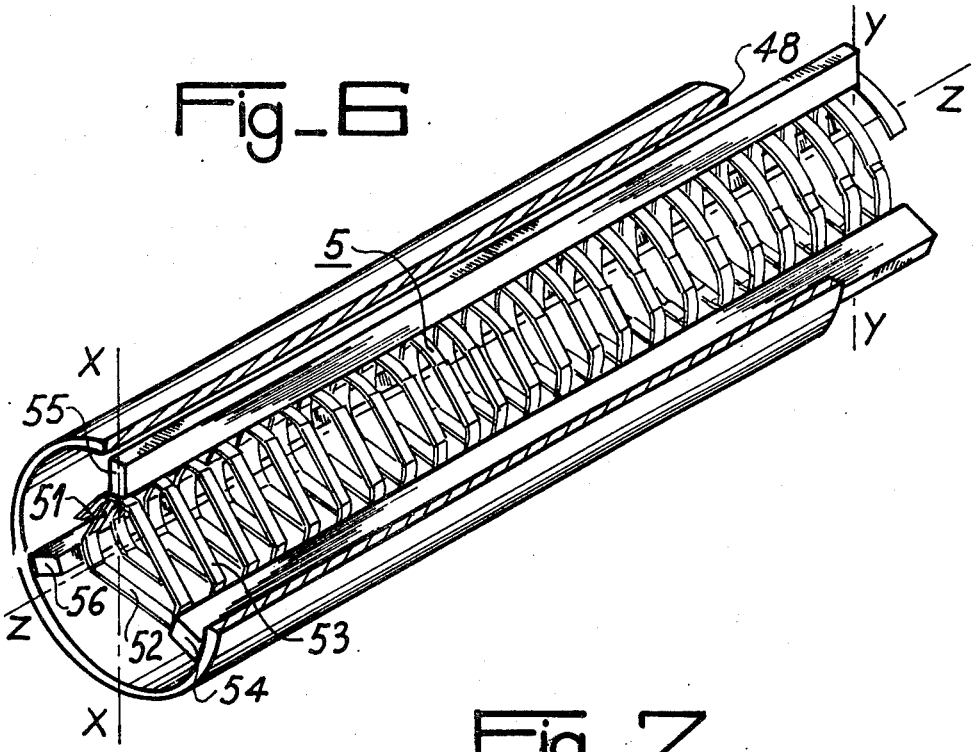

FIG. 6 shows a perspective view of a second embodiment of the delay line according to the invention.

Figure 7:
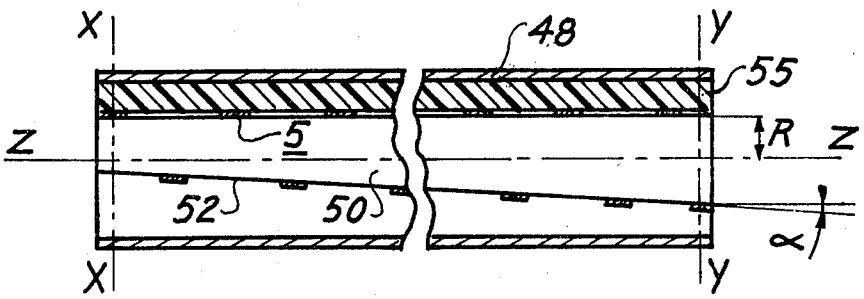

FIG. 7 shows the same line, seen in longitudinal section along the axis ZZ.

On these Figures is shown the tube 48, its axis being ZZ, which contains the delay line, which is now refered to as 5. In the middle of the line 5 passes the electron beam, along the axis ZZ.

During manufacture, line 5 is held by a mandrel 50, in the shape of a cylinder of radius R and axis ZZ, which is removed later. The mandrel 50 is shown in FIG. 7. As in the preceding Figures, mandrel 50 and thus line 5 have several flat surfaces (for example three: 51, 52 and 53 in the drawings), but these flat surfaces make an angle $\alpha$ which is constant, in relation to the axis ZZ.

The line 5, which is for example made like line 4, is here held in tube 48 by insulating rods, i.e. three rods 54, 55 and 56. These rods are positioned on the parts of the line 5 which are parallel to the axis ZZ, i.e. the cylindrical parts of the line which have no flat surfaces. This makes it possible for the rods to have a rectangular longitudinal section though the line has a variable diameter. This feature clearly appears in the longitudinal section of FIG. 7, which is made to the right of the rod 54.

Figure 8A:
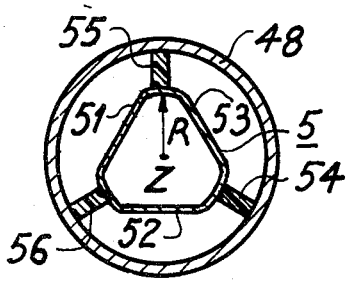
Figure 8B:
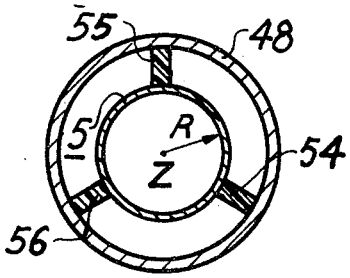

FIGS. 8*a* and 8*b* are views of transverse sections of the line shown in FIGS. 6 and 7, at each of its ends (respectively along the axes XX and YY of FIG. 7).

In FIG. 8*a*, line 5 is of radius R for its curved parts, which bear the rods 54, 55 and 56, and have three flat surfaces (51, 52 and 53) between these curved parts.

In FIG. 8*b*, line 5 is circular, of radius R.

Figure 9:
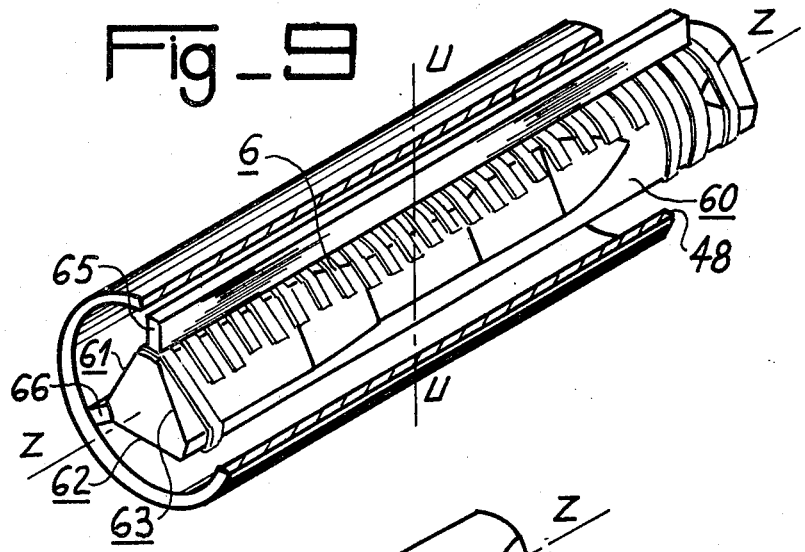

FIG. 9 shows a perspective view of a third embodiment of the delay line according to the invention.

Figure 11:
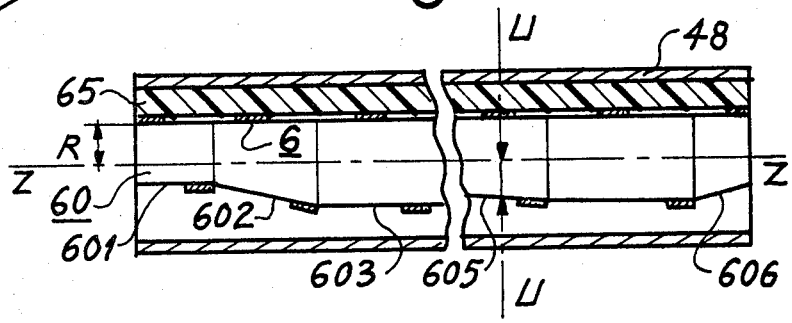

FIG. 11 shows the same line, seen in longitudinal section along the axis ZZ.

Figure 10:
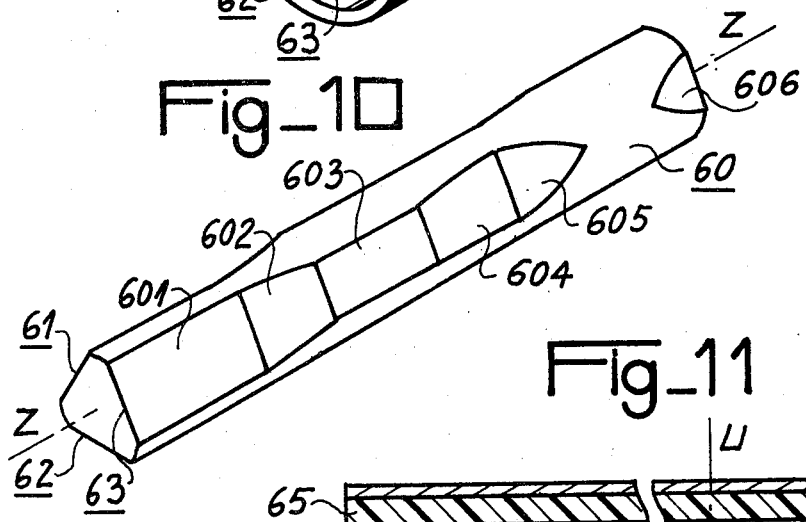

On these Figures is shown the tube 48, of axis ZZ, which contains the delay line, which now bears the reference 6. The line 6 is shown wound on its mandrel 60, with incomplete whorls for clearness. The mandrel 60 is shown in FIG. 10.

Mandrel 60 is constituted by a cylindrical surface (of radius R) on which series of flat surfaces have been made. In the Figures, mandrel 60 comprises three series (61, 62 and 63) of six flat surfaces (601 to 606 for the series 63, in FIG. 10). Each flat surface of the same series, makes a given angle in relation to axis ZZ, which is different from the angle made by next flat surface. The result is the non monotonous variation of the diameter of the delay line 6 which is wound on mandrel 60. The distance d in the drawings is the distance between the axis ZZ and a given point of a flat surface.

Figure 12:
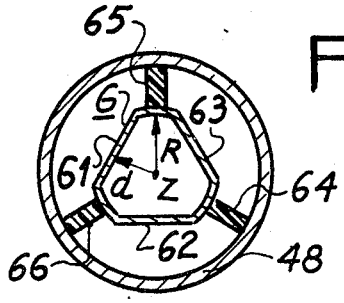

There are three insulating rods which support the delay line (64, 65 and 66), positioned on the cylindrical parts of the line, as shown in FIGS. 9 and 12. FIG. 12 is a transverse section of the line shown in FIG. 9, along an axis UU perpendicular to the axis ZZ. The line 6 has circular parts of radius R and flat surfaces (61 to 63) which are at a distance d from the axis ZZ. The line 6 is isolated from the tube 48 by the rods 64, 65 and 66, positioned on said circular parts.

As in the preceding embodiments, it is possible with this structure to use rods having a rectangular longitudinal section.

Figure 13:
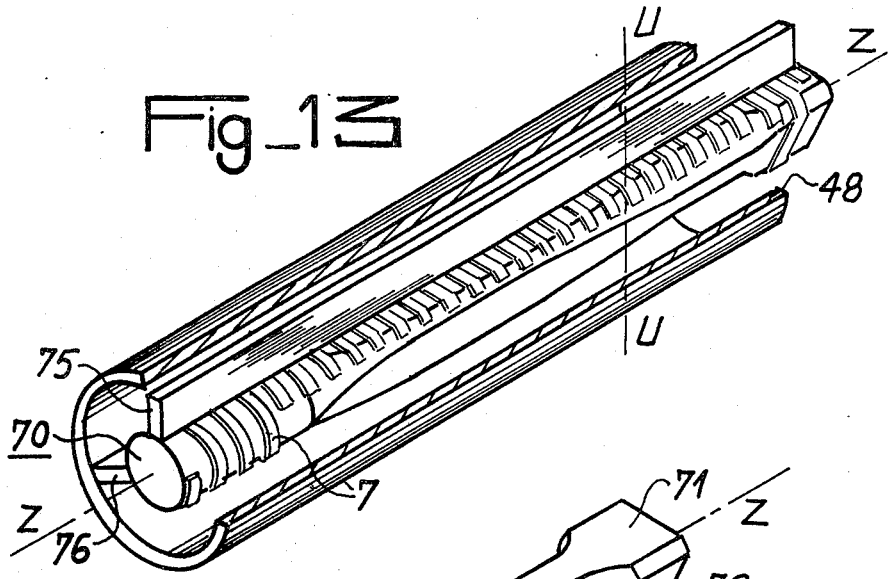

FIG. 13 shows a perspective view of a fourth embodiment of the delay line according to the invention.

Figure 15:
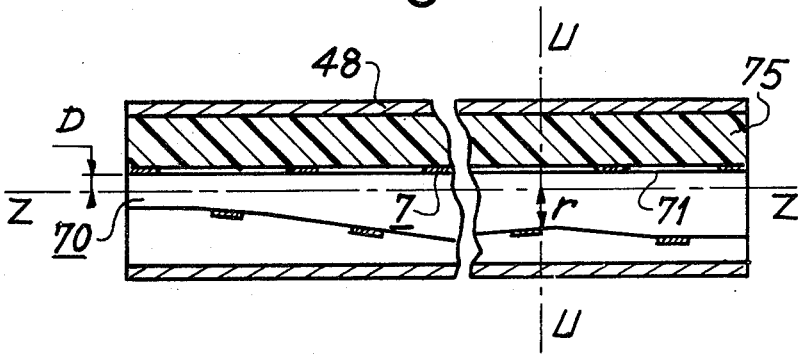

FIG. 15 shows the same line, seen in longitudinal section along the axis ZZ.

Figure 14:
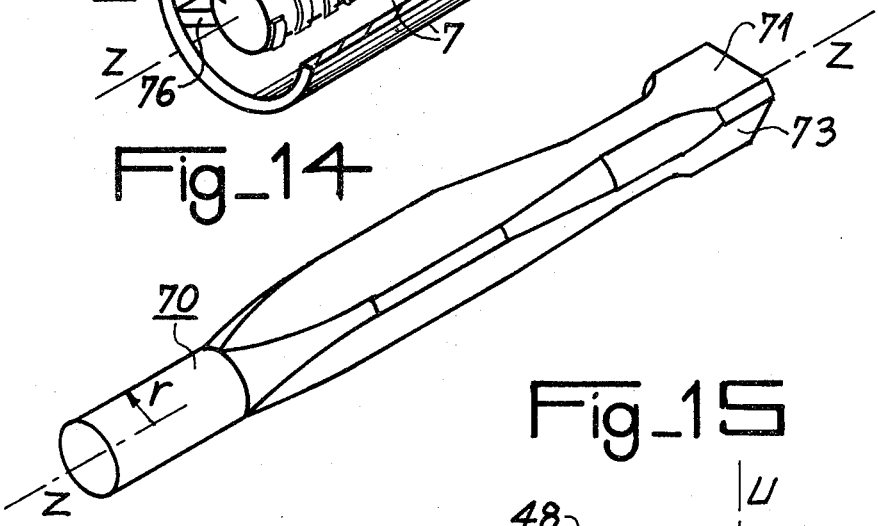

On these Figures is shown the tube 48, of axis ZZ, which contains the delay line which is now refered to as 7. The line 7 is shown wound on its mandrel 70, with incomplete whorls for clearness. The mandrel 70 is shown in FIG. 14.

Mandrel 70 is constituted by a revolution surface which has a diameter (2r) variable in a non monotonous way, on which flat surfaces (71 to 73) have been made. These flat surfaces are parallel to the axis ZZ, at a constant distance D from the latter. The support rods 74, 75 and 76, are of rectangular longitudinal section and are positioned on the flat surfaces (respectively 73, 71 and 72) as in the case of FIGS. 2 to 5.

Figure 16:
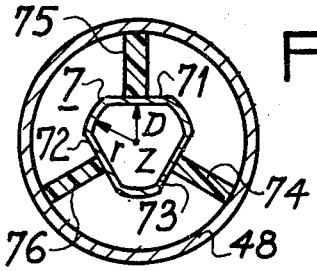

FIG. 16 is a transverse section of the line shown in FIG. 13, along an axis UU. There can be seen the rods 74 to 76, positioned on the flat surfaces of the line 7.

Of course, the preceding description is done by way of non limitative example. Thus, for example, the number of support rods is not critical. Also, the delay line may be of a variable pitch helical structure, an arrangement producing an improvement in certain characteristics of travelling wave tubes.

What is claimed:

1. A delay line for a travelling wave tube, comprising a helix having a plurality of adjacent turns about an axis; several of said adjacent turns having on each turn at least three first zones spaced approximately equally from each other and at least three second zones interspaced with said first zones, said first and second zones of one turn being adjacent to the corresponding first and second zones on an adjacent turn, the distance between the axis and said first zones being constant and the distance between the axis and said second zones varying from one turn to another.

2. A delay line according to claim 1 wherein said distance variations of said second zones are monotonous (FIGS. 2 to 5 and 6 to 8(*b*)).

3. A delay line according to claim 1 wherein said distance variations of said second zones (d) are non-monotonous (FIGS. 9 to 12; 601, 602, . . . , 606; or (r) in FIGS. 13 to 16).

4. A delay line according to claim 2 wherein said first zones are flat surfaces, and said second zones are revolution surfaces which together define the shape of a truncated cone with a small and large base (2D and 2R, FIGS. 2 to 5).

5. A delay line according to claim 4 wherein said flat surfaces are at a distance (D) from said axis approximately the same as the radius of the small base of said truncated cone.

6. A delay line according to claim 2 wherein said first zones are revolution surfaces together defining the shape of a cylinder, and said second zones are flat surfaces, with adjacent second zones making an angle ($\alpha$) with said axis (FIGS. 6 to 8(*b*)).

7. A delay line according to claim 3 wherein said first zones are revolution surfaces together defining the shape of a cylinder, and said second zones are flat surfaces (FIGS. 9 to 12; 61, 62, 63) with groups of adjacent second zones (601, 602 . . . 606) making different angles with said axis.

8. A delay line according to claim 3 wherein said first zones (FIGS. 13 to 16; 71, 72, 73) are flat surfaces and said second zones are revolution surfaces.

9. A travelling wave tube according to claim 1 further comprising a cylindrical tube (48) coaxial (Z—Z) with said helix (4); and at least three parallelopiped support rods (44–46, 54–56, 64–66, 74–76) between said first zones and said tube for supporting said delay line in said tube.

* * * * *